US010463907B2

(12) United States Patent
English

(10) Patent No.: US 10,463,907 B2
(45) Date of Patent: Nov. 5, 2019

(54) BENCH PRESS APPARATUS WITH SPOTTER PLATFORM

(71) Applicant: Steven E. English, Honolulu, HI (US)

(72) Inventor: Steven E. English, Honolulu, HI (US)

( * ) Notice: Subject to any disclaimer, the term of this patent is extended or adjusted under 35 U.S.C. 154(b) by 93 days.

(21) Appl. No.: 15/956,553

(22) Filed: Apr. 18, 2018

(65) Prior Publication Data

US 2018/0296872 A1 Oct. 18, 2018

Related U.S. Application Data

(60) Provisional application No. 62/486,712, filed on Apr. 18, 2017.

(51) Int. Cl.
*A63B 21/078* (2006.01)
*A63B 21/00* (2006.01)

(52) U.S. Cl.
CPC ..... *A63B 21/078* (2013.01); *A63B 21/4029* (2015.10); *A63B 2208/0252* (2013.01)

(58) Field of Classification Search
CPC ..... A63B 2208/0252; A63B 2225/093; A63B 23/12–1209; A63B 23/1236; A63B 21/4029–4031; A63B 21/078–0783
See application file for complete search history.

(56) References Cited

U.S. PATENT DOCUMENTS 3,524,644 A * 8/1970 Kane ..... A63B 21/023 482/129
4,252,314 A * 2/1981 Ceppo ..... A63B 21/00181 482/104
4,253,662 A * 3/1981 Podolak ..... A63B 21/00181 482/104
4,729,561 A * 3/1988 Desjardins ..... A63B 21/078 482/104
5,141,480 A * 8/1992 Lennox ..... A63B 21/078 482/104
5,433,687 A * 7/1995 Hinzman ..... A63B 21/00047 248/580
5,665,038 A * 9/1997 Miller ..... A63B 21/078 482/104
5,725,460 A * 3/1998 Marsh ..... A63B 21/078 482/104
6,605,023 B1 * 8/2003 Mobley ..... A63B 21/078 482/142

(Continued)

*Primary Examiner* — Andrew S Lo
(74) *Attorney, Agent, or Firm* — Schwabe, Williamson & Wyatt, P.C.

(57) ABSTRACT

Apparatuses and systems associated with bench press equipment are disclosed herein. In embodiments, a bench press apparatus may include a bench with a bar rack structure. The bar rack structure may include a first side structure located on a first side of the bench and a second side structure located on a second side of the bench, the first side of the bench being opposite to the second side of the bench. A connection structure may couple the first side structure to the second side structure and provide rigidity between the first side structure and the second side structure. The bench press apparatus may further include a platform located between the bench and a surface. The platform may extend along an end of the bench and at least a portion of the first side and the second side of the bench. Other embodiments may be described and/or claimed.

17 Claims, 6 Drawing Sheets

(56) References Cited

U.S. PATENT DOCUMENTS 7,226,400 B1* 6/2007 Gedeon-Janvier ... A63B 21/072 482/104
7,285,077 B1* 10/2007 Marx ..... A63B 21/06 482/104
7,753,830 B1* 7/2010 Marsh ..... A63B 21/078 482/104
7,927,263 B1* 4/2011 Marsh ..... A63B 21/078 108/134
9,545,540 B1* 1/2017 Moschel ..... A63B 22/0046
9,878,201 B1* 1/2018 Moschel ..... A63B 22/0012
9,919,183 B1* 3/2018 Moschel ..... A63B 22/0605
2003/0032524 A1* 2/2003 Lamar ..... A63B 21/00 482/8
2003/0134723 A1* 7/2003 Greenland ..... A63B 21/06 482/104
2004/0259696 A1* 12/2004 Shifferaw ..... A63B 21/0615 482/94
2005/0192167 A1* 9/2005 Shifferaw ..... A63B 21/0615 482/94
2005/0277524 A1* 12/2005 Bae ..... A63B 21/00181 482/93
2006/0135324 A1* 6/2006 Rullestad ..... A63B 21/00181 482/93
2007/0155597 A1* 7/2007 Hockemeyer ..... A63B 21/078 482/99
2009/0143203 A1* 6/2009 Knapp ..... A63B 21/078 482/104
2009/0286658 A1* 11/2009 James ..... A63B 21/078 482/104
2009/0312162 A1* 12/2009 Maiaro ..... A63B 21/078 482/104
2011/0172066 A1* 7/2011 Roppolo ..... A63B 21/078 482/104
2013/0190143 A1* 7/2013 Greenhill ..... A63B 21/0058 482/104
2013/0324373 A1* 12/2013 Lawrence ..... A63B 23/03558 482/94
2014/0228175 A1* 8/2014 Lemos ..... A63B 21/00076 482/5
2015/0202485 A1* 7/2015 Towley, III ..... A63B 21/154 482/104
2016/0101310 A1* 4/2016 Staten ..... A63B 21/0618 482/98
2016/0158591 A1* 6/2016 Early ..... A63B 21/0724 482/104
2017/0001064 A1* 1/2017 Vorozilchak ..... A63B 21/4047
2017/0028246 A1* 2/2017 Vorozilchak ..... A63B 21/078
2017/0361149 A1* 12/2017 Duffin ..... A63B 21/0783

* cited by examiner

BENCH PRESS APPARATUS WITH SPOTTER PLATFORM

RELATED APPLICATIONS

The present application claims priority to U.S. Provisional Patent Application No. 62/486,712, filed Apr. 18, 2017, entitled "BENCH PRESS APPARATUS WITH SPOTTER PLATFORM", the entire disclosure of which is hereby incorporated by reference.

TECHNICAL FIELD

The present disclosure relates to the field of exercise equipment. More particularly, the present disclosure relates to bench press exercise equipment.

BACKGROUND

The background description provided herein is for the purpose of generally presenting the context of the disclosure. Unless otherwise indicated herein, the materials described in this section are not prior art to the claims in this application and are not admitted to be prior art by inclusion in this section.

To ensure the safety of an individual performing a chest press on bench press equipment, often a second individual (herein referred to as a 'spotter') will stand toward an end of the bench and ensure that the individual performing the exercise does not drop the barbell and/or weights, which could result in harm to the individual and/or the spotter. Additionally, the spotter may help to lift the barbell and/or weights if the individual begins to struggle, to help align the barbell with the bar rack mechanism, to steady the barbell over the individual at the beginning of exercise or during the exercise, or some combination thereof.

Legacy bench press equipment often includes structure and/or supports that extend between the bench and bar rack structure. The structure and/or supports may present tripping hazards and/or points of interference with the standing position of the spotter, causing the spotter to stand adjacent to the end of the bench to avoid the structure and/or supports. Standing adjacent to the end of the bench causes the spotter to lean over when helping to lift the barbell and/or weights, which may heighten the risk of injury to the spotter, including back injuries that could result from leaning over while lifting heavy weights.

Some embodiments of legacy bench press equipment may attempt to limit the structure and/or supports that extend between the bench and the bar rack structure, thereby attempting to limit the tripping hazards and/or points of interference presented by the structure and/or supports. Limiting the structure and/or supports that extend between the bench and the bar rack structure often cause the bar rack structure to be less sturdy than legacy bench press equipment with greater structure and/or supports that extend between the bench and the bar rack structure. In these embodiments with limited structure and/or supports, the bar rack structure may provide inadequate support for heavy weights and/or may wear over time causing the bar rack structure to fail and present a risk of the barbell and/or weights falling from the bar rack mechanism.

BRIEF DESCRIPTION OF THE DRAWINGS

Embodiments will be readily understood by the following detailed description in conjunction with the accompanying drawings. To facilitate this description, like reference numerals designate like structural elements. Embodiments are illustrated by way of example, and not by way of limitation, in the figures of the accompanying drawings.

DETAILED DESCRIPTION

Figure 1:
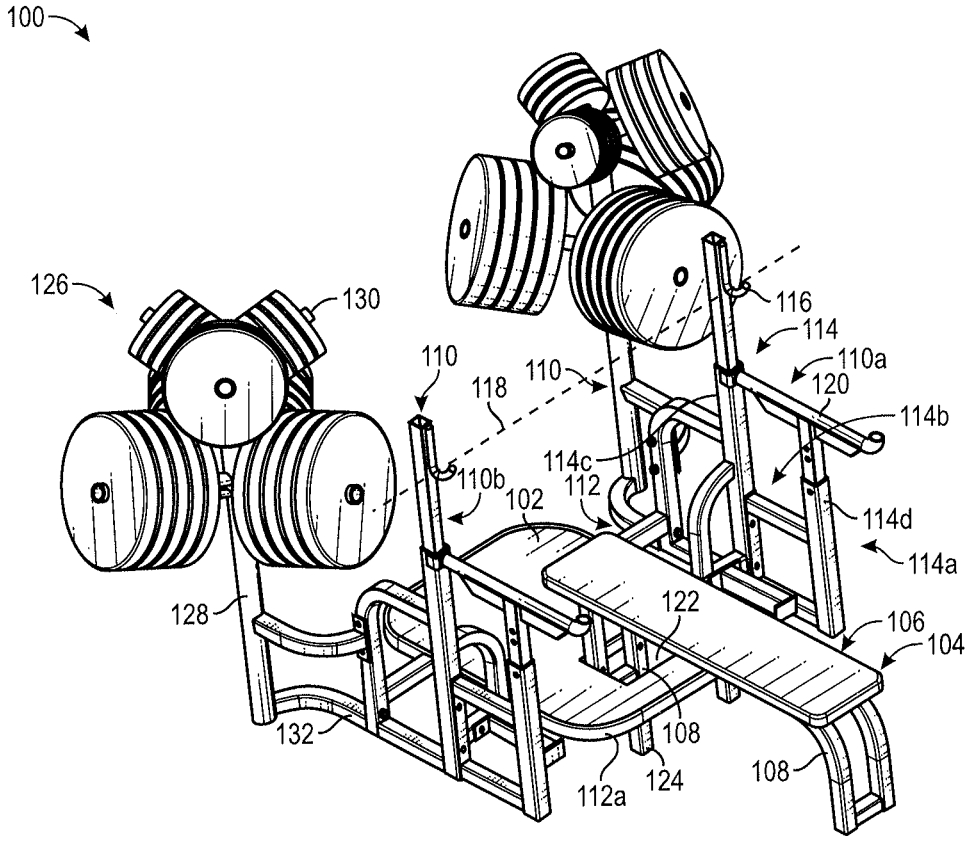
FIG. 1 illustrates example neutral bench press equipment with spotter platform, according to various embodiments.

Apparatuses and systems associated with bench press equipment are disclosed herein. In embodiments, a bench press apparatus may include a bench with a bar rack structure. The bar rack structure may include a first side structure located on a first side of the bench and a second side structure located on a second side of the bench, the first side of the bench being opposite to the second side of the bench. A connection structure may couple the first side structure to the second side structure and provide rigidity between the first side structure and the second side structure. The bench press apparatus may further include a platform located between the bench and a surface. The platform may extend along an end of the bench and at least a portion of the first side and the second side of the bench.

In the following detailed description, reference is made to the accompanying drawings which form a part hereof wherein like numerals designate like parts throughout, and in which is shown by way of illustration embodiments that may be practiced. It is to be understood that other embodiments may be utilized and structural changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that like elements disclosed below are indicated by like reference numbers in the drawings.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The description may use the phrases "in an embodiment," or "in embodiments," which may each refer to one or more of the same or different embodiments. Furthermore, the terms "comprising," "including," "having," and the like, as used with respect to embodiments of the present disclosure, are synonymous.

The description may use the phrase "structure" and the corresponding drawings may illustrate shaped, rigid tubes as the "structure." However, it is to be understood that the "structure" is not limited to shaped, rigid tubes. The "structure" may be any rigid element that may provide the same structural support and/or structural features as the shaped, rigid tubes, including, but not limited to, rigid plates, solid posts, or other similar structural elements.

FIG. 1 illustrates example neutral bench press equipment 100 with spotter platform 102, according to various embodiments. The bench press equipment 100 may include a bench 104. The bench 104 may include a flat surface 106 on which an individual performing a chest press may lie in a supine position. The flat surface 106 may include padding and/or a cushion to provide comfort for the individual. The flat surface 106 may be substantially parallel (within five degrees) to a surface on which the bench press equipment 100 is placed.

The flat surface 106 of the bench 104 may be supported by bench support structure 108 on a surface (such a gym floor, ground, similar surfaces, or some combination thereof) on which the bench press equipment 100 is placed. The bench support structure 108 may include one or more legs (and/or similar support mechanisms) located at opposing ends of the flat surface 106. In some embodiments, additional legs (and/or the similar support mechanisms) may be located under the flat surface 106 between the opposing ends, may extend from under the flat surface 106 beyond the length and/or width of the flat surface 106, or some combination thereof. Further, in some embodiments, the bench support structure 108 may be coupled to and/or incorporated with other structure and/or supports of the bench press equipment 100, including the spotter platform 102.

In some embodiments, an angle of the flat surface 106 relative to the surface on which the bench press equipment 100 is placed may be adjustable. The bench support structure 108 may include one or more adjustment mechanisms that may cause at least a portion of the bench support structure 108 to extend and/or contract in length, which may cause at least a portion of the flat surface 106 to transition to a location further from and/or closer to the surface on which the bench press equipment 100 is placed. The bench support structure 108 may include a hinge mechanism or other pivot mechanism located near one of the ends of the flat surface 106. As the portion of the bench support structure 108 is extended or contracted, the flat surface 106 may rotate about the hinge mechanism or other pivot mechanism causing the angle of the flat surface 106 to the surface on which the bench press equipment 100 is placed to change.

The bench press equipment 100 may include bar rack structure 110 that may extend on both sides of the bench 104. A first side 110*a* of the bar rack structure 110 may be located on a first side of the bench 104 and a second side 110*b* of the bar rack structure 110 may be located on a second side of the bench 104, the second side of the bench 104 being opposite to the first side of the bench 104. In some embodiments, the first side 110*a* and the second side 110*b* may be structurally mirrored about a center, bisecting line of the bench 104, such that the structure of the first side 110*a* and the second side 110*b* are similar.

The first side 110*a* and the second side 110*b* may be coupled to each other by connection structure 112 that extends between the first side 110*a* and the second side 110*b*. The connection structure 112 may include shaped, rigid tubes that extend between the first side 110*a* and the second side 110*b*. The connection structure 112 may extend beneath the flat surface 106 of the bench 104, outside of the footprint of the bench 104 (including beyond the sides and/or ends of the bench 104), or some combination thereof. The connection structure 112 may extend along the surface on which the bench press equipment 100 is placed, above the surface on which the bench press equipment 100 is placed, or some combination thereof. The connection structure 112 may provide rigidity between the first side 110*a*, the second side 110*b*, the bench 104, or some combination thereof, thereby providing sturdiness to the first side 110*a* and the second side 110*b* to support the barbell and/or weights when the barbell and/or weights are placed on the bar rack structure 110. While the connection structure 112 illustrated includes shaped, rigid tubes, it is to be understood that the connection structure 112 is not limited to the rigid tubes and may include any structural elements that may couple and provide rigidity between the first side 110*a*, the second side 110*b*, the bench 104, or some combination thereof, including, but not limited to, solid extensions, rigid plates, or some combination thereof.

As the first side 110*a* of the bar rack structure 110 and the second side 110*b* of the bar rack structure 110 may be mirror images of each other, the first side 110*a* is described herein and it is to be understood that the second side 110*b* may include the same features as the first side 110*a*. Differences that may exist between the first side 110*a* and the second side 110*b* are mentioned herein.

The first side 110*a* may include a vertical structure 114. The vertical structure 114 may include one or more shaped, rigid tubes 114*a* (herein referred to as 'the tubes 114*a*') that extend in a vertical direction from the surface on which the bench press equipment 100 is placed. The vertical structure 114 may further include one or more shaped, rigid cross tubes 114*b* that may extend between the one or more tubes 114*a* that extend in the vertical direction, the cross tubes 114*b* providing rigidity between the tubes 114*a* that extend in the vertical direction. The tubes 114*a* and/or the cross tubes 114*b* of the first side 110*a* may be coupled to corresponding tubes that extend in the vertical direction and/or cross tubes of the second side 110*b* by the connection structure 112. The connection structure 112 may provide rigidity and/or sturdiness between the vertical structure 114 of the first side 110*a* and a corresponding vertical structure of the second side 110*b*. While the vertical structure 114 illustrated includes shaped, rigid tubes, it is to be understood that the vertical structure 114 is not limited to the rigid tubes and may include any structural elements that may provide the features described in relation to the vertical structure 114.

The vertical structure 114 may include a first bar rack mechanism 116. The first bar rack mechanism 116 may receive a barbell and may support at least a portion of the barbell and/or weights mounted to the barbell. The first bar rack mechanism 116 of the first side 110*a* and a corresponding first bar rack mechanism of the second side 110*b* may support the entirety of the barbell and/or weights mounted to the barbell when both of the first bar rack mechanisms receive the barbell.

The first bar rack mechanism 116 may be coupled to a first tube 114*c* of the tubes 114*a*. The first tube 114*c* to which the first bar rack mechanism 116 is coupled may be located to a side of the bench 104. The first bar rack mechanism 116 may include a rigid structure with a portion of the rigid structure extending in an upward direction away from the first tube 114*c*. The first bar rack mechanism 116 may provide a resting position for the barbell when received by the first bar rack mechanism 116, the resting position being located at a nadir of the first bar rack mechanism 116 created by the portion of the rigid structure extending in the upward direction.

The first bar rack mechanism 116 may be located at an elevated position along the first tube 114*c*, wherein the first bar rack mechanism 116 is located at a further distance from the surface on which the bench press equipment 100 is placed than the bench 104 is located from the surface. The first bar rack mechanism 116 may be located a distance above the bench 104 corresponding to an average, or below average, length of an individual's arms when extended in front of the individual. Accordingly, the individual may place the barbell on the first bar rack mechanism 116 when the individual's arms are fully or substantially (i.e. a slight bend at the individual's elbows) extended in front of the individual.

In some embodiments, the distance between the first bar rack mechanism 116 and the flat surface 106 of the bench 104 may be adjustable. The first tube 114*c*, on which the first bar rack mechanism 116 is located, may include a length adjustment mechanism to adjust a length of the first tube 114*c*. Adjusting the length of the first tube 114*c* may alter the distance between the first bar rack mechanism 116 and the surface on which the bench press equipment 100 is placed, which in turn alters the distance between the flat surface 106. The length adjustment mechanism may include a pin to maintain the length of the first tube 114*c* when the pin is inserted and allow the length to be changed when the pin is removed. In some embodiments, the length adjustment mechanism may further be spring-loaded to assist in increasing the distance between the first bar rack mechanism 116 and the surface on which the bench press equipment 100 is placed. In particular, a spring may be located within the first tube 114*c* that acts upon the first bar rack mechanism 116 and causes an upward force to be applied to the first bar rack mechanism 116. When the pin is removed, the spring may act upon the first bar rack mechanism 116, assisting an individual in increasing the distance between the first bar rack mechanism 116 and the surface.

In some embodiments, the first bar rack mechanism 116 may be removably coupled to the first tube 114*c* and may be coupled to the first tube 114*c* at multiple different positions along the length of the first tube 114*c*. Further, in some embodiments, a distance between the end of the flat surface 106 closest to the first tube 114*c* and the surface on which the bench press equipment 100 is placed may be adjustable via the bench support structure 108, which may cause the distance between the first bar rack mechanism 116 and the flat surface 106 to be altered.

The first bar rack mechanism 116 of the first side 110*a* and a corresponding first bar rack mechanism of the second side 110*b* may include a barbell resting position 118 (indicated by a dotted line) that extends between the nadirs of the first bar rack mechanisms. The barbell resting position 118 may extend above the flat surface 106 of the bench 104 in a direction perpendicular to, or substantially perpendicular (within fives degrees) to, the length of the flat surface 106. The barbell resting position 118 may extend above the flat surface 106 toward one end of the flat surface, the end intended to be where a head of the individual is positioned when performing a chest press on the bench press equipment 100. The barbell resting position 118 may be located above the flat surface 106 between a center of the length of the flat surface 106 and the end where the head of the individual is intended to be positioned.

The vertical structure 114 may further include a second bar rack mechanism 120. The second bar rack mechanism 116 may be coupled to one or more of the vertical tubes 114. In the illustrated embodiment, one end of the second bar rack mechanism 120 may be coupled to the first tube 114*c* of the tubes 114*a* and the second bar rack mechanism 120 may be coupled to a second tube 114*d* of the tubes 114*a* at a position along the length of the second bar rack mechanism 120. An upper end of the second tube 114*d* may be coupled to the lower side of the second bar rack mechanism 120 and may extend from the lower side of the second bar rack mechanism 120 to the surface on which the bench press equipment 100 is placed.

The second bar rack mechanism 120 may extend from the first tube 114*c* in a direction that is substantially perpendicular (within five degrees) to the first tube 114*c* and/or substantially parallel (with five degrees) to the surface on which the bench press equipment is placed. The second bar rack mechanism 120 may extend further from the first tube 114*c* than the first bar rack mechanism 120 extends from the first tube 114*c*. The second bar rack mechanism 120 may extend parallel to the length of the flat surface 106 of the bench 104 and may extend for at least a portion of the length of the flat surface 106. In some embodiments, the second bar rack mechanism 120 may extend from the first tube 114*c* for a distance of at least half the length of the flat surface 106. An end of the second bar rack mechanism 120 opposite to the end that couples to the first tube 114 may curve and/or extend upwards and may prevent the barbell from rolling off the second bar rack mechanism 120 when the barbell is received by the second bar rack mechanism 120.

The second bar rack mechanism 120 may be located at a distance from the surface on which the bench press equipment 100 is placed between the distance from the first bar rack mechanism 116 to the surface and the distance from the flat surface 106 of the bench 104 to the surface. The second bar rack mechanism 120 may be located at a distance above the flat surface 106 of the bench 104 corresponding to an average chest width of an individual, the chest width measuring from the individual's back to the individual's chest. In some embodiments, the second bar rack mechanism 120 may be located at a distance above the flat surface 106 greater or less than the average chest width of an individual. The second bar rack mechanism 120 may prevent the barbell from being lowered below an acceptable minimum distance between the flat surface 106 and the barbell. When the barbell is lowered to the acceptable minimum distance, the barbell may contact the second bar rack mechanism 120 preventing the barbell from being lowered any further. Based on the position of the second bar rack mechanism 120, the individual may be able to lower the barbell to a position where the barbell may contact or almost contact the individual's chest, while the second bar rack mechanism 120 prevents the barbell from being lowered to a lower position that may result in injury to the individual.

In some embodiments, the distance between the second bar rack mechanism 120 and the flat surface 106 of the bench 104 may be adjusted. The second bar rack mechanism 120 may be attached to portions of the first tube 114*c* and the second tube 114*d* that may be adjusted relative to the surface on which the bench press equipment 100 is placed, such that the distances between the connection points of the second bar rack mechanism 120 with the first tube 114*c* and the second tube 114*d* and the surface may change. As the distance between the connection points and the surface changes, the distance between the second bar rack mechanism 120 and the flat surface 106 may change correspondingly. The distances may be adjusted by length adjustment mechanisms included on the first tube 114*c* and the second tube 114*d*, which may include pins to maintain the lengths of the first tube 114*c* and the second tube 114*d* when the pins are inserted and allow the lengths to be changed when the pins are removed. In some embodiments, the length adjustment mechanism may further be spring-loaded to assist in increasing the distance between the second bar rack mechanism 120 and the flat surface 106. In particular, a spring may be located within the second tube 114*d* that acts upon the second bar rack mechanism 120 and causes an upward force to be applied to the second bar rack mechanism 120. When the pin is removed, the spring may act upon the second bar rack mechanism 120, assisting an individual in increasing the distance between the second bar rack mechanism 120 and the flat surface 106.

In some embodiments, a distance between the end of the flat surface 106 closest to the first tube 114*c* and the surface on which the bench press equipment 100 is placed may be adjustable via the bench support structure 108, which may cause the distance between the second bar rack mechanism 120 and the flat surface 106 to be altered.

Further, in some embodiments, the second bar rack mechanism 120 may be omitted from the bench press equipment 100. In some of these embodiments, the second tube 114*d* and the cross tubes 114*b* coupling the second tube 114*d* to the rest of the vertical structure 114 and/or the connection structure 112 may be omitted. In others of these embodiments, a portion of the second tube 114*d* and the cross tubes 114*b* may still be included in the bench press equipment 100 while the second bar rack mechanism 120 may be omitted.

The bench press equipment may include the spotter platform 102. The spotter platform 102 may include a flat, rigid surface, which may be coupled to the bench 104, connection structure 112, the bar rack structure 110, or some combination thereof. The spotter platform 112 may extend substantially parallel (within five degrees) to the surface on which the bench press equipment 100 is placed and/or the flat surface 106 of the bench 104. In some embodiments, the spotter platform 102 may include one or more steps leading up to the flat surface of the spotter platform 102 that a spotter may use to step onto the spotter platform 102.

The spotter platform 102 may support the weight of one or more individuals and the weight of the barbell and weights mounted to the barbell. In some embodiments, the spotter platform 102 may support upwards of 4,000 pounds. In other embodiments, the spotter platform 102 may support less weight and may be designed to meet desired specifications. The spotter platform 102 may provide a platform on which one or more spotters can stand unimpeded by the connection structure 112, allowing the spotters to stand close to the bench 104, straddling the bench 104, and/or on either side of the bench 104, which the structure and/or supports of legacy bench press equipment may prevent or impede. The spotter platform 102 may allow the spotters to stand in line with barbell resting position 118, close to the barbell resting position 118, over the flat surface 106 of the bench 104, or some combination thereof. This positioning of the spotters may allow the spotters to lift with their knees when helping to lift the barbell and/or weights rather than their backs, thereby reducing the risk of injury to the spotters.

The spotter platform 102 may be raised off a surface on which the bench press equipment 100 is placed. The spotter platform 102 may be at least partially supported on the surface on which the bench press equipment is placed by one or more spotter platform support tubes 124. In some embodiments, the distance between the surface on which the bench press equipment 100 is placed and the spotter platform 102 may be adjustable via raising or lowering the spotter platform 102. The spotter platform 102 may be raised or lowered by extending or contracting the spotter platform support tubes 124. The spotter platform support tubes 124 may include pins that maintain a position of the spotter platform 102 when inserted and may allow the position of the spotter platform 102 to be adjusted when the pins are removed. Adjusting the position of the spotter platform 102 may change the distance between the first bar rack mechanism 116 and the spotter platform 102, allowing the spotters to adjust the spotter platform 102 to a position that may allow the spotters to help lift the barbell and/or weights to the first bar rack mechanism 116 using their legs rather than having to rely on arm and/or back muscles to raise barbell and/or weights to the first bar rack mechanism 116.

In some embodiments, the spotter platform support tubes 124 may implement a spring-loaded system to assist in increasing the distance between the spotter platform 102 and the surface on which the bench press equipment 100 is placed. In particular, a spring may be located within the spotter platform support tubes 124 that acts upon a portion of the spotter platform support tubes 124 and causes an upward force to be applied to the portion of the spotter platform support tubes 124. When the pin is removed, the spring may act upon the portion of the spotter platform support tubes 124, assisting an individual in increasing the distance between the spotter platform 102 and the surface on which the bench press equipment 100 is placed.

The connection structure 112 extending between the first side 110*a* and the second side 110*b* of the bar rack structure 110 may be below a height of the spotter platform 102, at a same height of the spotter platform 102, or some combination thereof. The spotter platform 102 may be positioned such that no portion of the connection structure 112 passes above an entirety of the spotter platform 102. In some embodiment, the spotter platform 102 may be positioned on the surface on which the bench press equipment 100 is placed and the connection structure 112 may be at the same height of the spotter platform 102 and/or coupled to the spotter platform 102 without passing above the entirety of the spotter platform 102.

In the illustrated embodiment, the connection structure 112 may include one or more rigid tubes coupled to the spotter platform 102, which may partially support the spotter platform 102. In particular, the connection structure 112 may include a tube 112*a* coupled to the spotter platform 102 and that extends around the exterior of the spotter platform 102. In some embodiments, the connection structure 112 may include additional tubes coupled to the spotter platform 102, no tubes coupled to the spotter platform 102, tubes passing under the spotter platform 102, or some combination thereof. Further, in some embodiments, the spotter platform 102 may help provide rigidity and/or sturdiness to the bar rack structure 110 when the spotter platform 102 is coupled to the connection structure 112.

The spotter platform 102 may extend outwards from the bench 104 from both sides of the bench 104, either side of the bench 104, the end of the bench 104 that an individual's head is intended to be positioned when performing a chest press on the bench press equipment 100, or some combination thereof. In some embodiments, the spotter platform 102 may extend along the sides of the flat surface 106 for at least a quarter of the length of the flat surface 106. In some embodiments, the spotter platform 102 may further extend below the flat surface 106 of the bench 104. The spotter platform 102 may include one or more apertures 122 for the bench support structure 108 to pass through, such that the bench support structure 108 contacts the surface on which the bench press equipment 100 is placed and supports the flat surface 106 of the bench 104 on the surface. In some embodiments, the spotter platform 102 may be coupled to the bench support structure 108, the bench support structure 108 partially supporting the spotter platform 102.

Further, in some embodiments, the bench support structure 108 located within the footprint of the spotter platform 102 may be coupled to the flat surface of the spotter platform 102 and may not directly contact the surface on which the bench press equipment 100 is placed. In these embodiments, the portion of the bench support structure 108 located within the footprint of the spotter platform 102 may be supported by the spotter platform 102 and the apertures 122 may be omitted. It is to be understood in these embodiments that the portion of the bench support structure 108 located outside of the footprint of the spotter platform 102 may still make direct contact with the surface on which the bench press equipment 100 is placed.

The bench press equipment 100 may further include one or more weight racks 126. The weight racks 126 may be coupled to the connection structure 112, the bar rack structure 110, or some combination thereof. The weight racks 126 may be coupled via one or more cross tubes 132.

The weight racks 126 may each include a vertical weight holder tube 128 with one or more weight holder tube extrusions 130 extending from the vertical weight holder tube 128. The weight holder tube extrusions 130 may extend from the vertical weight holder tube 128 in an upward direction, causing weights to be mounted on the weight holder tube extrusions 130 to slide toward and/or against the vertical weight holder tube 128 when placed on the weight holder tube extrusions 130 due to gravitational force acting upon the weights.

The weight holder tube extrusions 130 may rotate about the vertical weight holder tube 128. The weight holder tube extrusions 130 may be affixed to a portion of the vertical weight holder tube 128 that may rotate in response to rotational force applied to the weight holder tube extrusions 130, the portion of the vertical weight holder tube 128, or some combination thereof. In some embodiments, the weight holder tube extrusions 130 may be rigidly affixed to the vertical weight holder tube 128, such that the weight holder tube extrusions 130 do not rotate about the vertical weight holder tube 128.

In some embodiments, the weight racks 126 may be omitted from the bench press equipment 100. In these embodiments, the vertical weight holder tube 128, the weight holder tube extrusions 130, the cross tubes 132, or some combination thereof may be omitted from the bench press equipment 100.

Figure 2:
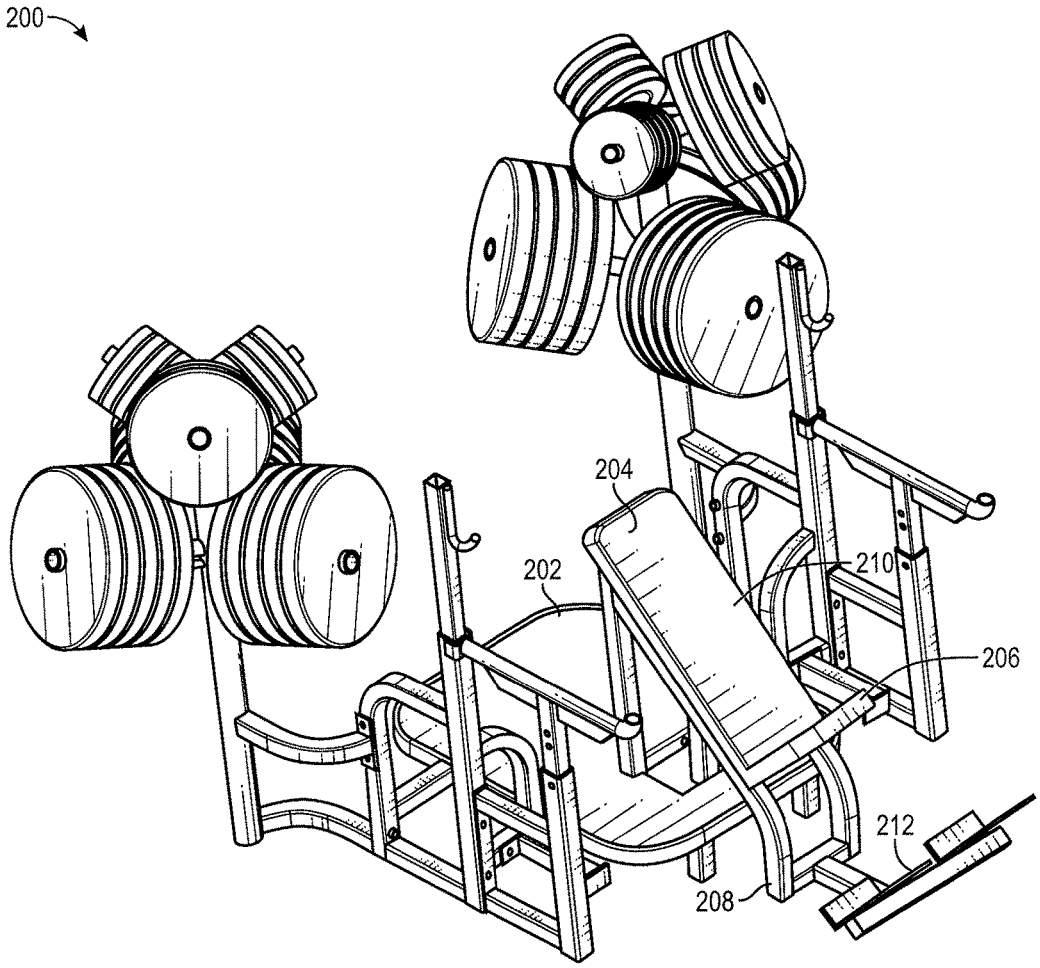
FIG. 2 illustrates example incline bench press equipment with spotter platform, according to various embodiments.

FIG. 2 illustrates example incline bench press equipment 200 with spotter platform 202, according to various embodiments. The incline bench press equipment 200 may include one or more of the features of the neutral bench press equipment 100 (FIG. 1), including the connection structure 112 (FIG. 1), the bar rack structure 110 (FIG. 1), the weight racks 126 (FIG. 1), or some combination thereof. Further, the spotter platform 202 may include one or more of the features of the spotter platform 102 (FIG. 1).

Due to the inclusion of these one or more features from the neutral bench press equipment 100 in the incline bench press equipment 200, the following description of the incline bench press equipment 200 will focus on differences that may exist between the incline bench press equipment 200 and the neutral bench press equipment 100. Those features not described in relation to the incline bench press equipment 200 and that are described previously in relation to the neutral bench press equipment 100 are to be understood to be included or omitted in the incline bench press equipment 200 in accordance with the description of the features in relation to the neutral bench press equipment 100. For example, as the weight racks 126 may be included or omitted in different embodiments of the neutral bench press equipment 100 as described above, it is to be understood that the weight racks 126 may also be included or omitted in different embodiments of the incline bench press equipment 200.

Further, the relationships between features described in relation to the neutral bench press equipment 100 may be maintained as to the same features included in the incline bench press equipment 200, unless otherwise stated. For example, the first side 110*a* (FIG. 1) of the bar rack structure 110 and the second side 110*b* (FIG. 1) of the bar rack structure 110 may maintain the relationship of being mirror images of each other in the incline bench press equipment 200 as described in relation to the neutral bench press equipment 100.

The bench press equipment 200 may include an inclined bench 210. The inclined bench 210 may include a back surface 204. The back surface 204 may be a flat surface on which an individual performing an incline chest press may lie and may at least partially support the weight of the individual. The back surface 204 may include padding and/or a cushion to provide comfort for the individual. The back surface 204 may extend at an angle to the surface on which the bench press equipment 200 is placed, with a first end of the back surface 204 located toward where a head of the individual is intended to be positioned when performing the incline chest press is further from the surface than the other end of the back surface 204 located toward where a lower back of the individual is intended to be positioned when performing the incline chest press.

The inclined bench 210 may further include a seat surface 206. The seat surface 206 may abut the end of the back surface 204 located toward where a lower back of the individual is intended to be positioned when performing the incline chest press and may extend substantially perpendicular (within five degrees) to the back surface 204. The seat surface 206 may be a flat surface on which an individual performing an incline chest press may sit and may at least partially support the weight of the individual. The seat surface 206 may include padding and/or a cushion to provide comfort for the individual.

In some embodiments, a position of the seat surface 206 relative to the back surface 204 may be adjustable. The seat surface 206 may adjust from a position abutting the end of the back surface 204 to a certain distance away from the back surface 204, the seat surface 206 maintaining its substantially perpendicular (within five degrees) position relative to the back surface 204 while being adjusted. The seat surface 206 may be adjusted along a plane parallel to the back surface 204. The seat surface 206 may be adjusted by an adjustment mechanism that includes a pin, where the pin maintains a position of the seat surface 206 when inserted and allows adjustment of the seat surface 206 when removed.

The back surface 204 and/or the seat surface 206 of the inclined bench 210 may be supported by bench support structure 208 on a surface (such a gym floor, ground, similar surfaces, or some combination thereof) on which the bench press equipment 200 is placed. The bench support structure 208 may include one or more of the features of the bench support structure 108 (FIG. 1). The bench support structure 208 may include one or more legs (and/or similar support mechanisms) located at opposing ends of the back surface 204. In some embodiments, additional legs (and/or the similar support mechanisms) may be located under the back surface 204 between the opposing ends, may extend from under the back surface 204 beyond the length and/or width of the back surface 204, or some combination thereof. In some embodiments, a portion of the legs and/or additional legs may be coupled to the seat surface 206 and extend from the seat surface 206 to the surface on which the bench press equipment 200 is placed. Further, in some embodiments, the bench support structure 208 may be coupled to and/or incorporated with other structure and/or supports of the bench press equipment 200, including the spotter platform 202.

The bench support structure 208 may include a footrest 212. The footrest 212 may include one or more flat surfaces on which an individual may place his feet while performing an incline chest press. The footrest 212 may be aligned with the back surface 204 of the inclined bench 210 and may extend substantially perpendicularly (within five degrees) to the back surface 204. In some embodiments, the footrest 212 may be omitted from the bench press equipment 200.

In some embodiments, an angle of the back surface 204 relative to the surface on which the bench press equipment 200 is placed may be adjustable. The seat surface 206 and/or the foot rest 212 may be adjusted as the angle of the back surface 204 is adjusted, maintaining to the relative positions and substantially perpendicular angles (within five degrees) between the seat surface 206 and the back surface 204, and the foot rest 212 and the back surface 204. The bench support structure 208 may include one or more adjustment mechanisms that may cause at least a portion of the bench support structure 208 to extend and/or contract in length, which may cause at least a portion of the back surface 204 to transition to a location further from and/or closer to the surface on which the bench press equipment 200 is placed. The bench support structure 208 may include a hinge mechanism or other pivot mechanism located near one of the ends of the back surface 204. As the portion of the bench support structure 208 is extended or contracted, the back surface 204 may rotate about the hinge mechanism or other pivot mechanism causing the angle of the back surface 204 to the surface on which the bench press equipment 200 is placed to change.

In some embodiments, the adjustment mechanisms of the bench support structure 208 may implement a spring-loaded system to assist in increasing the distance between the portion of the back surface 204 and the surface on which the bench press equipment 200 is placed. In particular, a spring may be located within the bench support structure 208 that acts upon a portion of the bench support structure 208 and causes an upward force to be applied to the portion of the bench support structure 208. The spring may act upon the portion of the bench support structure 208, assisting an individual in increasing the distance between the portion of the back surface 204 and the surface on which the bench press equipment 200 is placed.

Figure 3:
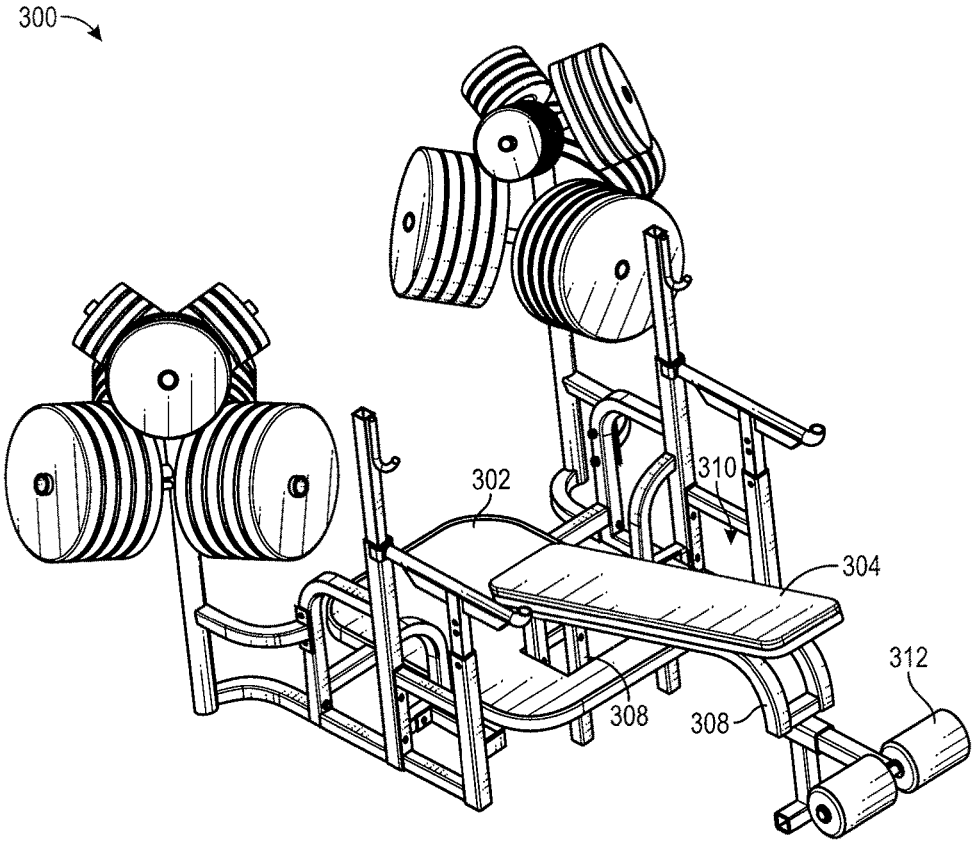
FIG. 3 illustrates example decline bench press equipment with spotter platform, according to various embodiments.

FIG. 3 illustrates example decline bench press equipment 300 with spotter platform 302, according to various embodiments. The decline bench press equipment 300 may include one or more of the features of the neutral bench press equipment 100 (FIG. 1), including the connection structure 112 (FIG. 1), the bar rack structure 110 (FIG. 1), the weight racks 126 (FIG. 1), or some combination thereof. Further, the spotter platform 302 may include one or more of the features of the spotter platform 102 (FIG. 1).

Due to the inclusion of these one or more features from the neutral bench press equipment 100 in the decline bench press equipment 300, the following description of the decline bench press equipment 300 will focus on differences that may exist between the decline bench press equipment 300 and the neutral bench press equipment 100. Those features not described in relation to the decline bench press equipment 300 and that are described previously in relation to the neutral bench press equipment 100 are to be understood to be included or omitted in the decline bench press equipment 300 in accordance with the description of the features in relation to the neutral bench press equipment 100. For example, as the weight racks 126 may be included or omitted in different embodiments of the neutral bench press equipment 100 as described above, it is to be understood that the weight racks 126 may also be included or omitted in different embodiments of the decline bench press equipment 300.

Further, the relationships between features described in relation to the neutral bench press equipment 100 may be maintained as to the same features included in the decline bench press equipment 300, unless otherwise stated. For example, the first side 110*a* (FIG. 1) of the bar rack structure 110 and the second side 110*b* (FIG. 1) of the bar rack structure 110 may maintain the relationship of being mirror images of each other in the decline bench press equipment 300 as described in relation to the neutral bench press equipment 100.

The bench press equipment 300 may include a declined bench 310. The declined bench 310 may include a back surface 304. The back surface 304 may be a flat surface on which an individual performing a decline chest press may lie and may at least partially support the weight of the individual. The back surface 304 may include padding and/or a cushion to provide comfort for the individual. The back surface 304 may extend at an angle to the surface on which the bench press equipment 300 is placed, with a first end of the back surface 304 located toward where a head of the individual is intended to be positioned when performing the decline chest press is closer to the surface than the other end of the back surface 304 located toward where a lower back of the individual is intended to be positioned when performing the decline chest press.

The back surface 304 of the inclined bench 310 may be supported by bench support structure 308 on a surface (such a gym floor, ground, similar surfaces, or some combination thereof) on which the bench press equipment 300 is placed. The bench support structure 308 may include one or more of the features of the bench support structure 108 (FIG. 1). The bench support structure 308 may include one or more legs (and/or similar support mechanisms) located at opposing ends of the back surface 304. In some embodiments, additional legs (and/or the similar support mechanisms) may be located under the back surface 304 between the opposing ends, may extend from under the back surface 304 beyond the length and/or width of the back surface 304, or some combination thereof. Further, in some embodiments, the bench support structure 308 may be coupled to and/or incorporated with other structure and/or supports of the bench press equipment 300, including the spotter platform 302.

The bench support structure 308 may include a leg support 312. The leg support 312 may include one or more elements (which may be round or rounded as illustrated, or flat), which an individual performing a decline chest press may press his feet and/or legs against to steady his body while performing the decline chest press. The leg support 312 may include padding for the comfort of the individual performing the decline chest press. The leg support 312 may be located toward an end of the back surface 304 where the individual's lower back is intended to be positioned when performing the decline chest press and may be a certain distance away from the end. The leg support 312 may be located substantially perpendicular (within five degrees) to the end of the back surface 304 and configured to allow the individual to bend at his knees to hook his legs and/or feet around the leg support 312 and press against the leg support. In some embodiments, the leg support 312 may be adjustable to adjust the angle of the leg support 312 to the end of the back surface 304.

In some embodiments, an angle of the back surface 304 relative to the surface on which the bench press equipment 300 is placed may be adjustable. The leg support 312 may be adjusted as the angle of the back surface 304 is adjusted, maintaining to the relative position between the footrest 312 and the back surface 304. The bench support structure 308 may include one or more adjustment mechanisms that may cause at least a portion of the bench support structure 308 to extend and/or contract in length, which may cause at least a portion of the back surface 304 to transition to a location further from and/or closer to the surface on which the bench press equipment 300 is placed. The bench support structure 308 may include a hinge mechanism or other pivot mechanism located near one of the ends of the back surface 304. As the portion of the bench support structure 308 is extended or contracted, the back surface 304 may rotate about the hinge mechanism or other pivot mechanism causing the angle of the back surface 304 to the surface on which the bench press equipment 300 is placed to change.

In some embodiments, the adjustment mechanisms of the bench support structure 308 may implement a spring-loaded system to assist in increasing the distance between the portion of the back surface 304 and the surface on which the bench press equipment 300 is placed. In particular, a spring may be located within the bench support structure 308 that acts upon a portion of the bench support structure 308 and causes an upward force to be applied to the portion of the bench support structure 308. The spring may act upon the portion of the bench support structure 308, assisting an individual in increasing the distance between the portion of the back surface 304 and the surface on which the bench press equipment 300 is placed.

Figure 4:
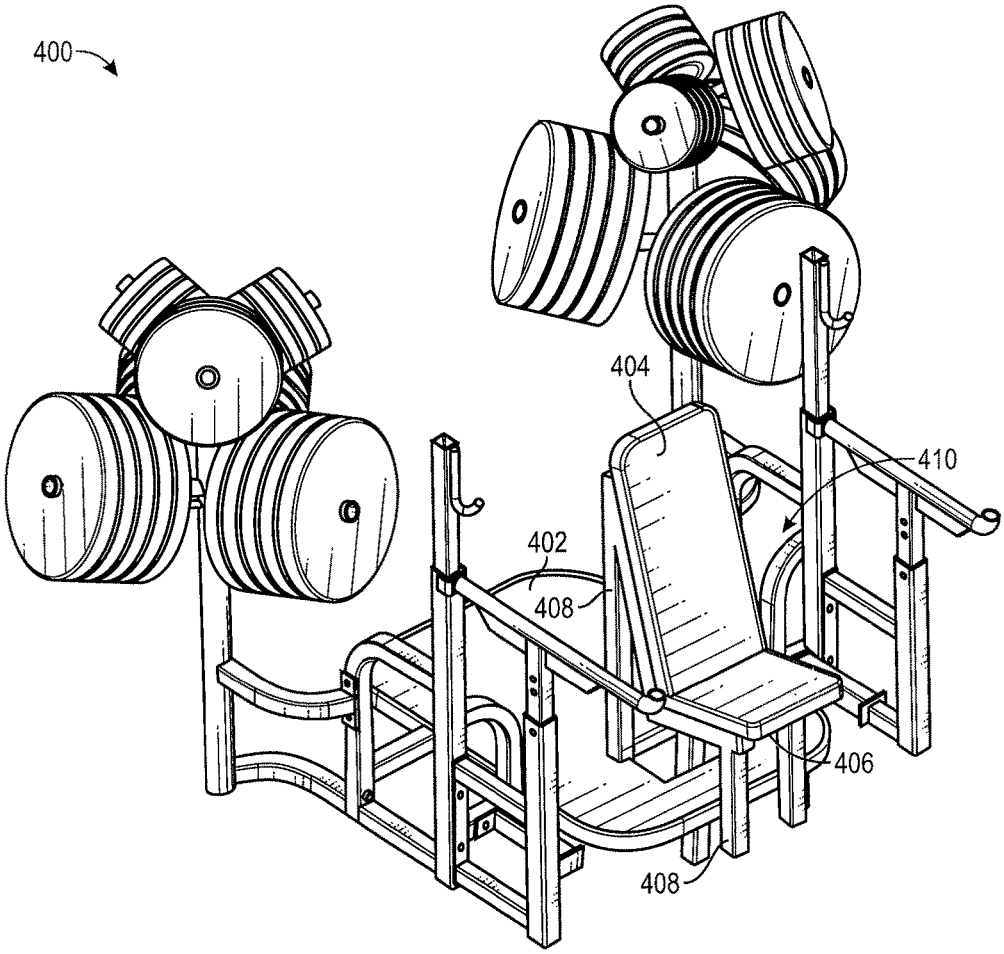
FIG. 4 illustrates example military press equipment with spotter platform, according to various embodiments.

FIG. 4 illustrates example military press equipment 400 with spotter platform 402, according to various embodiments. The military press equipment 400 may include one or more of the features of the neutral bench press equipment 100 (FIG. 1), including the connection structure 112 (FIG. 1), the bar rack structure 110 (FIG. 1), the weight racks 126 (FIG. 1), or some combination thereof. Further, the spotter platform 402 may include one or more of the features of the spotter platform 102 (FIG. 1).

Due to the inclusion of these one or more features from the neutral bench press equipment 100 in the military press equipment 400, the following description of the military press equipment 400 will focus on differences that may exist between the military press equipment 400 and the neutral bench press equipment 100. Those features not described in relation to the military press equipment 400 and that are described previously in relation to the neutral bench press equipment 100 are to be understood to be included or omitted in the military press equipment 400 in accordance with the description of the features in relation to the neutral bench press equipment 100. For example, as the weight racks 126 may be included or omitted in different embodiments of the neutral bench press equipment 100 as described above, it is to be understood that the weight racks 126 may also be included or omitted in different embodiments of the military press equipment 400.

Further, the relationships between features described in relation to the neutral bench press equipment 100 may be maintained as to the same features included in the military press equipment 400, unless otherwise stated. For example, the first side 110*a* (FIG. 1) of the bar rack structure 110 and the second side 110*b* (FIG. 1) of the bar rack structure 110 may maintain the relationship of being mirror images of each other in the military press equipment 400 as described in relation to the neutral bench press equipment 100.

The military press equipment 400 may include a seated bench 410. The seated bench 410 may include a back surface 404. The back surface 404 may be a flat surface on which an individual performing a military press may sit with his back against and may help steady the upper body of the individual during the military press and/or at least partially support the weight of the individual. The back surface 404 may include padding and/or a cushion to provide comfort for the individual. The back surface 404 may extend perpendicular or at an angle to the surface on which the military press equipment 400 is placed, with a first end of the back surface 404 located toward where a head of the individual is intended to be positioned when performing the military press is further from the surface than the other end of the back surface 404 located toward where a lower back of the individual is intended to be positioned when performing the military press. In some embodiments, the angle of the back surface 404 to the surface on which the military press equipment 400 is placed may be between 70 degrees and 90 degrees (perpendicular) to the surface.

The seated bench 410 may further include a seat surface 406. The seat surface 406 may abut the end of the back surface 404 located toward where a lower back of the individual is intended to be positioned when performing the military press and may extend substantially perpendicular (within five degrees) to the back surface 404. In some embodiments, the seat surface 406 may extend parallel to the surface on which the military press equipment 400 is placed, and may or may not be substantially perpendicular to the back surface 404. The seat surface 406 may be a flat surface on which an individual performing a military press may sit and may at least partially support the weight of the individual. The seat surface 406 may include padding and/or a cushion to provide comfort for the individual.

In some embodiments, a position of the seat surface 406 relative to the back surface 404 may be adjustable. The seat surface 406 may adjust from a position abutting the end of the back surface 404 to a certain distance away from the back surface 404, the seat surface 406 maintaining its substantially perpendicular (within five degrees) position relative to the back surface 404 while being adjusted. The seat surface 406 may be adjusted along a plane parallel to the back surface 404. The seat surface 406 may be adjusted by an adjustment mechanism that includes a pin, where the pin maintains a position of the seat surface 406 when inserted and allows adjustment of the seat surface 406 when removed.

The back surface 404 and/or the seat surface 406 of the seated bench 410 may be supported by bench support structure 408 on a surface (such a gym floor, ground, similar surfaces, or some combination thereof) on which the military press equipment 400 is placed. The bench support structure 408 may include one or more of the features of the bench support structure 108 (FIG. 1). The bench support structure 408 may include one or more legs (and/or similar support mechanisms) with one pair of legs located at one end of the back surface 404 and another pair of legs located at one end of the seat surface 406. In some embodiments, additional legs (and/or the similar support mechanisms) may be located under the back surface 404 and/or the seat surface 406, may extend from under the back surface 404 and/or the seat surface 406 beyond the length and/or width of the back surface 404 and/or the seat surface 406, or some combination thereof. Further, in some embodiments, the bench support structure 408 may be coupled to and/or incorporated with other structure and/or supports of the military press equipment 400, including the spotter platform 402.

In some embodiments, an angle of the back surface 404 relative to the surface on which the military press equipment 400 is placed may be adjustable. The seat surface 406 may be adjusted as the angle of the back surface 404 is adjusted, maintaining to the relative positions and substantially perpendicular angles (within five degrees) between the seat surface 406 and the back surface 404. The bench support structure 408 may include one or more adjustment mechanisms that may cause at least a portion of the bench support structure 408 to extend and/or contract in length, which may cause at least a portion of the back surface 404 to transition to a location further from and/or closer to the surface on which the military press equipment 400 is placed. The bench support structure 408 may include a hinge mechanism or other pivot mechanism located near one of the ends of the back surface 404, one of the ends of the seat surface 406, or some combination thereof. As the portion of the bench support structure 408 is extended or contracted, the back surface 404 may rotate about the hinge mechanism or other pivot mechanism causing the angle of the back surface 404 to the surface on which the military press equipment 400 is placed to change.

In some embodiments, the adjustment mechanisms of the bench support structure 408 may implement a spring-loaded system to assist in increasing the distance between the portion of the back surface 404 and the surface on which the military press equipment 400 is placed. In particular, a spring may be located within the bench support structure 408 that acts upon a portion of the bench support structure 408 and causes an upward force to be applied to the portion of the bench support structure 408. The spring may act upon the portion of the bench support structure 408, assisting an individual in increasing the distance between the portion of the back surface 404 and the surface on which the military press equipment 400 is placed.

Figure 5:
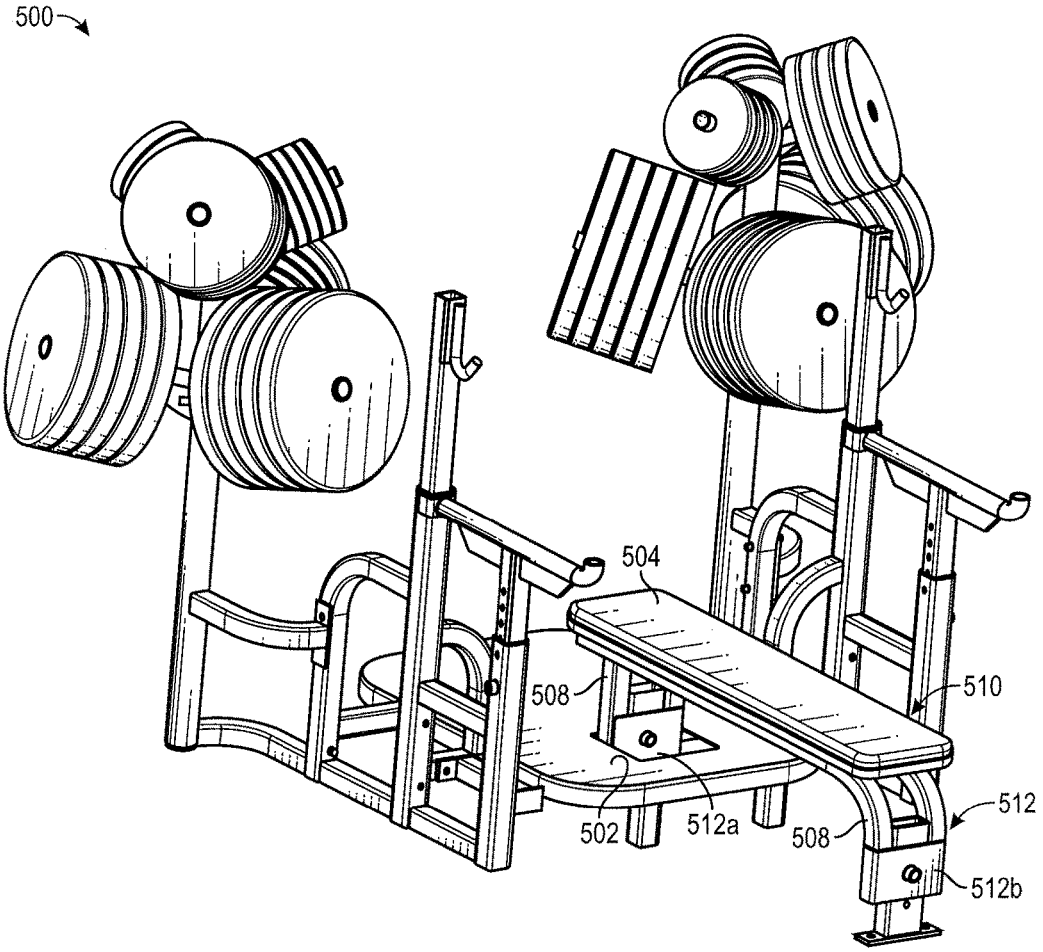
FIG. 5 illustrates example adjustable neutral bench press equipment with spotter platform, according to various embodiments.

FIG. 5 illustrates example adjustable neutral bench press equipment 500 with spotter platform 502, according to various embodiments. The adjustable neutral bench press equipment 500 may include one or more of the features of the neutral bench press equipment 100 (FIG. 1), including the connection structure 112 (FIG. 1), the bar rack structure 110 (FIG. 1), the weight racks 126 (FIG. 1), or some combination thereof. Further, the spotter platform 502 may include one or more of the features of the spotter platform 102 (FIG. 1).

Due to the inclusion of these one or more features from the neutral bench press equipment 100 in the adjustable neutral bench press equipment 500, the following description of the adjustable neutral bench press equipment 500 will focus on differences that may exist between the adjustable neutral bench press equipment 500 and the neutral bench press equipment 100. Those features not described in relation to the adjustable neutral bench press equipment 500 and that are described previously in relation to the neutral bench press equipment 100 are to be understood to be included or omitted in the adjustable neutral bench press equipment 500 in accordance with the description of the features in relation to the neutral bench press equipment 100. For example, as the weight racks 126 may be included or omitted in different embodiments of the neutral bench press equipment 100 as described above, it is to be understood that the weight racks 126 may also be included or omitted in different embodiments of the adjustable neutral bench press equipment 500.

Further, the relationships between features described in relation to the neutral bench press equipment 100 may be maintained as to the same features included in the adjustable neutral bench press equipment 500, unless otherwise stated. For example, the first side 110*a* (FIG. 1) of the bar rack structure 110 and the second side 110*b* (FIG. 1) of the bar rack structure 110 may maintain the relationship of being mirror images of each other in the adjustable neutral bench press equipment 500 as described in relation to the neutral bench press equipment 100.

The adjustable neutral bench press equipment 500 may include an adjustable bench 510. The adjustable bench 510 may include a back surface 504. The back surface 504 may be a flat surface on which an individual performing a chest press may lie and may at least partially support the weight of the individual. The back surface 504 may include padding and/or a cushion to provide comfort for the individual. The back surface 504 may extend substantially parallel (within five degrees) to the surface on which the adjustable neutral bench press equipment 500 is placed.

The back surface 504 of the adjustable bench 510 may be supported by bench support structure 508 on a surface (such a gym floor, ground, similar surfaces, or some combination thereof) on which the adjustable neutral bench press equipment 500 is placed. The bench support structure 508 may include one or more of the features of the bench support structure 108 (FIG. 1). The bench support structure 508 may include one or more legs (and/or similar support mechanisms) with one or more of the legs located at one end of the back surface 504 and one or more legs located at the other end of the back surface 504. In some embodiments, additional legs (and/or the similar support mechanisms) may be located under the back surface 504, may extend from under the back surface 504 beyond the length and/or width of the back surface 504, or some combination thereof. Further, in some embodiments, the bench support structure 508 may be coupled to and/or incorporated with other structure and/or supports of the adjustable neutral bench press equipment 500, including the spotter platform 502.

The bench support structure 508 may include one or more adjustment mechanisms 512, including first adjustment mechanism 512*a* and second adjustment mechanism 512*b*. The adjustment mechanisms 512 may provide adjustment of the back surface 504 relative to the surface on which the adjustable neutral bench press equipment 500 is placed. In particular, the adjustment mechanisms 512 may provide for extension and contraction of the legs (and/or the similar support mechanisms) of the bench support structure 508, thereby causing the adjustable bench 510 to move closer or further away from the surface on which the adjustable neutral bench press equipment 500 is placed in response to the extension and/or contraction. The adjustable bench 510 may remain substantially parallel (within five degrees) to the surface on which the adjustable neutral bench press equipment 500 is placed as the location of the adjustable bench 510 is adjusted.

In some embodiments, the adjustment mechanisms 512 of the bench support structure 508 may implement a spring-loaded system to assist in increasing the distance between the adjustable bench 510 and the surface on which the adjustable neutral bench press equipment 500 is placed. In particular, a spring may be located within the bench support structure 508 that acts upon a portion of the bench support structure 508 and causes an upward force to be applied to the portion of the bench support structure 508. The spring may act upon the portion of the bench support structure 508, assisting an individual in increasing the distance between the portion of the adjustable bench 510 and the surface on which the adjustable neutral bench press equipment 500 is placed.

Further, the location of the adjustable bench 510 relative to other portions of the adjustable neutral bench press equipment 500 may change as the legs (and/or the similar support mechanisms) are extended and/or contracted. In particular, the back surface 504 may move farther away from the spotter platform 502 as the legs are extended and may move closer to the spotter platform 502 as the legs are contracted.

The adjustment mechanisms 512 may include one or more jack mechanisms that provides for adjustment of the length of the legs via operation of the jack mechanisms. The jack mechanism may be a scissor jack mechanism that extends and contracts as the scissor jack mechanism is operated. In some embodiments, the adjustment mechanisms 512 may include a pin to maintain the length of the legs when the pin is inserted and allow the length to be changed when the pin is removed. Further, in some embodiments, the adjustment mechanisms 512 may include a crank mechanism that adjusts the length of the legs as a crank of the crank mechanism is rotated. In embodiments where the adjustment mechanism 512 includes a crank mechanism, a single crank may control the adjustment of the adjustment mechanisms 512.

Figure 6:
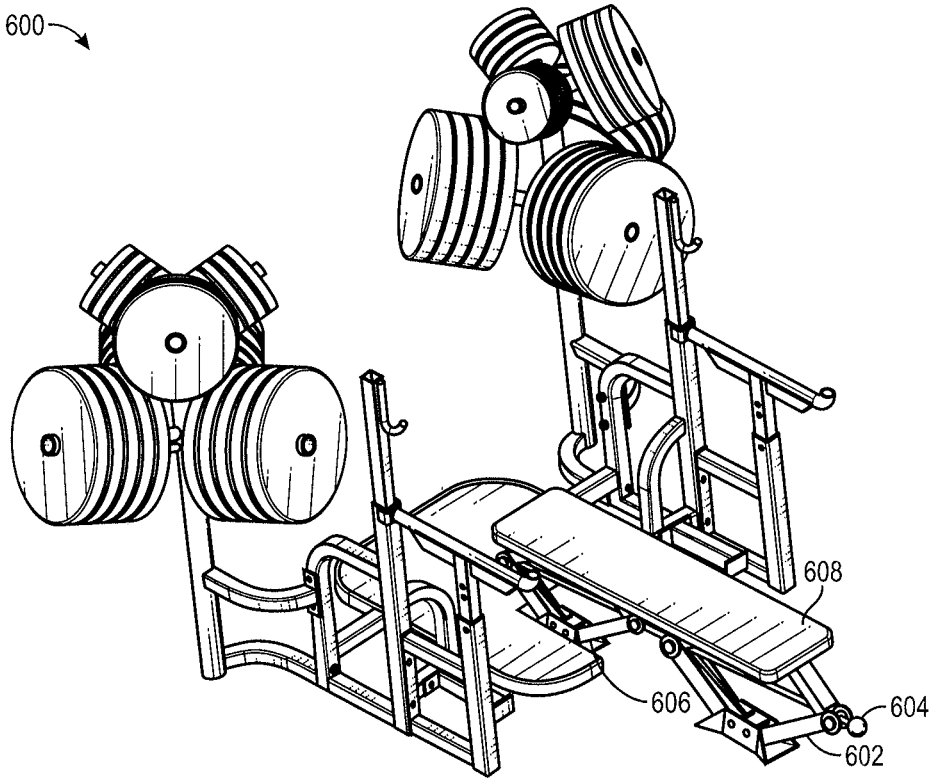
FIG. 6 illustrates example neutral bench press equipment with adjustment mechanism, according to various embodiments.

FIG. 6 illustrates example neutral bench press equipment 600 with an adjustment mechanism, according to various embodiments. In particular, the adjustment mechanism may include a first adjustment mechanism 602 and a second adjustment mechanism 606. The first adjustment mechanism 602 and the second adjustment mechanism 606 may be representative of jack mechanisms that may be implemented by the adjustment mechanisms 512 (FIG. 5). The neutral bench press equipment 600 may include one or more of the features of the neutral bench press equipment 100 (FIG. 1), including the connection structure 112 (FIG. 1), the bar rack structure 110 (FIG. 1), the weight racks 126 (FIG. 1), or some combination thereof.

Due to the inclusion of these one or more features from the neutral bench press equipment 100 in the neutral bench press equipment 600, the following description of the neutral bench press equipment 600 will focus on differences that may exist between the neutral bench press equipment 600 and the neutral bench press equipment 100. Those features not described in relation to the neutral bench press equipment 600 and that are described previously in relation to the neutral bench press equipment 100 are to be understood to be included or omitted in the neutral bench press equipment 600 in accordance with the description of the features in relation to the neutral bench press equipment 100. For example, as the weight racks 126 may be included or omitted in different embodiments of the neutral bench press equipment 100 as described above, it is to be understood that the weight racks 126 may also be included or omitted in different embodiments of the neutral bench press equipment 600.

Further, the relationships between features described in relation to the neutral bench press equipment 100 may be maintained as to the same features included in the neutral bench press equipment 600, unless otherwise stated. For example, the first side 110*a* (FIG. 1) of the bar rack structure 110 and the second side 110*b* (FIG. 1) of the bar rack structure 110 may maintain the relationship of being mirror images of each other in the neutral bench press equipment 600 as described in relation to the neutral bench press equipment 100.

The neutral bench press equipment 600 may include a bench 608. The bench 608 may include a flat surface on which an individual performing a chest press may lie in a supine position. The flat surface may include padding and/or a cushion to provide comfort for the individual. The flat surface may be substantially parallel (within five degrees) to a surface on which the neutral bench press equipment 600 is placed.

The bench 608 may be supported by the first adjustment mechanism 602 and the second adjustment mechanism 606 on a surface (such a gym floor, ground, similar surfaces, or some combination thereof) on which the neutral bench press equipment 600 is placed. The first adjustment mechanism 602 and the second adjustment mechanism 606 may provide adjustment of the bench 608 relative to the surface on which the neutral bench press equipment is placed. In particular, the first adjustment mechanism 602 and the second adjustment mechanism 606 may extend and contract, thereby causing the bench 608 to move closer or further away from the surface on which the neutral bench press equipment 600 is placed in response to the extension and/or contraction. The bench 608 may remain substantially parallel (within five degrees) to the surface on which the neutral bench press equipment 600 is placed as the location of the bench 608 is adjusted.

The first adjustment mechanism 602 may include a crank 604. Actuation of the crank 604 (which may include rotation of the crank 604) may cause the first adjustment mechanism 602 to extend or contract. The crank 604 may further be coupled to the second adjustment mechanism 606 and may cause the second adjustment mechanism 606 to extend or contract as the crank 604 is actuated.

In some embodiments, the first adjustment mechanism 602 and the second adjustment mechanism 606 may have separate cranks, allowing an individual to separately adjust first adjustment mechanism 602 and the second adjustment mechanism 606. In some of these embodiments, the first adjustment mechanism 602 and/or the second adjustment mechanism 606 may be coupled to the bench 608 by a hinge mechanism or other pivot mechanism. In embodiments with the hinge mechanism or other pivot mechanism, an angle of the bench 608 relative to a surface on which the neutral bench press equipment 600 is placed may change based on the adjustment caused by the first adjustment mechanism 602 and/or the second adjustment mechanism 606.

In other embodiments, the first adjustment mechanism 602 or the second adjustment mechanism 606 may be omitted. In particular, only one of the first adjustment mechanism 602 or the second adjustment mechanism 606 may be implemented in some embodiments. A hinge mechanism or other pivot mechanism may couple the first adjustment mechanism 602 or the second adjustment mechanism 606 with the bench 608 and an angle of the bench 608 relative to a surface on which the neutral bench press equipment 600 is placed may change based on the adjustment caused by the first adjustment mechanism 602 or the second adjustment mechanism 606.

It should be understood that the first adjustment mechanism 602 and/or the second adjustment mechanism 606 may be implemented in other embodiments of press equipment described herein. In particular, the first adjustment mechanism 602 and/or the second adjustment mechanism 606 may be implemented in the neutral bench press equipment 100 (FIG. 1), the incline bench press equipment 200 (FIG. 2), the decline bench press equipment 300 (FIG. 3), the military press equipment 400 (FIG. 4), and/or the adjustable neutral bench press equipment 500. For example, the first adjustment mechanism 602 and/or the second adjustment mechanism 606 may be implemented in place of, or as a portion of, the bench support structure 108 (FIG. 1), the bench support structure 208 (FIG. 2), the bench support structure 308 (FIG. 3), the bench support structure 408 (FIG. 4), and/or the bench support structure 508.

Example 1 may include a bench press apparatus, comprising a bench supported at a first elevated level above a surface, a bar rack structure, comprising a first side structure located on a first side of the bench, wherein the first side includes a first side bar rack mechanism to receive a first portion of a barbell and at least partially support the barbell, the first side bar rack mechanism located at a second elevated level above the surface, the second elevated level further from the surface than the first elevated level, a second side structure located on a second side of the bench, the first side of the bench being opposite to the second side of the bench, wherein the second side structure includes a second side bar rack mechanism to receive a second portion of the barbell and at least partially support the barbell, the second side bar rack mechanism located at the second elevated level above the surface, and connection structure that couples the first side structure to the second side structure, the connection structure to provide rigidity between the first side structure and the second side structure, and a platform located at a third elevated level above the surface, the third elevated level located between the first elevated level and the surface, wherein the platform extends along an end of the bench and at least partially along the first side of the bench and the second side of the bench, and wherein the connection structure passes between the platform and the surface within the surface of the platform.

Example 2 may include the bench press apparatus of example 1, wherein barbell is located in a barbell resting position when received by the first side bar rack mechanism and the second side bar rack mechanism, and wherein at least a portion of the platform is located directly between the barbell resting position and the surface.

Example 3 may include the bench press apparatus of example 1, wherein the platform extends along the first side of the bench and the second side of the bench for at least a quarter of the length of the bench.

Example 4 may include the bench press apparatus of example 1, wherein at least a portion of the platform extends directly between the bench and the surface, and wherein a portion of a bench support structure, that supports the bench at the first elevated level, passes through an aperture in the platform and at least partially supports the bench on the surface.

Example 5 may include the bench press apparatus of example 1, wherein the connection structure is coupled to the platform, and wherein the connection structure supports the platform at the third elevated level.

Example 6 may include press equipment, comprising a bench, a bench support structure coupled to the bench, the bench support structure to support the bench on a surface, and a platform located at a distance from the surface less than a distance from the bench to the surface, wherein the platform extends around a portion of the bench on at least three sides of the bench.

Example 7 may include the press equipment of example 6, wherein the platform extends on a first side of the bench and a second side of the bench, the second side of the bench being opposite to the first side of the bench, wherein the platform extends on the first side of the bench for at least a quarter of a length of the bench, and wherein the platform extends on the second side of the bench for at least a quarter of the length of the bench.

Example 8 may include the press equipment of example 6, wherein at least a portion of the platform extends directly between the bench and the surface, and where in the platform has an aperture through which at least a portion of the bench support structure extends.

Example 9 may include the press equipment of example 6, further comprising a bar rack structure, wherein a first side of the bar rack structure is located on a first side of the bench and a second side of the bar rack structure is located on a second side of the bench, the second side of the bench being opposite to the first side of the bench, and a connection structure that extends between the first side of the bar rack structure and the second side of the bar rack structure, wherein the connection structure is to provide rigidity to the bar rack structure.

Example 10 may include the press equipment of example 9, wherein the connection structure is located between the platform and the surface.

Example 11 may include the press equipment of example 9, wherein the connection structure is coupled to the platform, and wherein the connection structure is to support the platform at the distance from the surface.

Example 12 may include the press equipment of example 9, wherein the connection structure comprises one or more rigid tubes that extend between the first side of the bar rack structure.

Example 13 may include the press equipment of example 9, wherein the first side of the bar rack structure includes a first vertical structure, wherein the second side of the bar rack structure includes a second vertical structure, and wherein the press equipment further comprises a first bar rack mechanism of the first vertical structure, the first bar rack mechanism of the first vertical structure to receive a first portion of a barbell, wherein the bench is located between the first bar rack mechanism of the first vertical structure and the surface, a first bar rack mechanism of the second vertical structure, the first bar rack mechanism of the second vertical structure to receive a second portion of the barbell, wherein the bench is located between the first bar rack mechanism of the second vertical structure and the surface, a second bar rack mechanism of the first vertical structure, the second bar rack mechanism of the first vertical structure to receive the first portion of the barbell, wherein the second bar rack mechanism of the first vertical structure is located between the first bar rack mechanism of the first vertical structure and the bench, and a second bar rack mechanism of the second vertical structure, the second bar rack mechanism of the second vertical structure to receive the second portion of the barbell, wherein the second bar rack mechanism of the second vertical structure is located between the first bar rack mechanism of the second vertical structure and the bench.

Example 14 may include the press equipment of example 13, wherein the first vertical structure includes a first length adjustment mechanism to adjust a distance between the second bar rack mechanism of the first vertical structure and the bench, and wherein the second vertical structure includes a second length adjustment mechanism to adjust a distance between the second bar rack mechanism of the second vertical structure and the bench.

Example 15 may include the press equipment of example 14, wherein the first length adjustment mechanism is spring-loaded to assist with adjustment of the second bar rack mechanism of the first vertical structure, and wherein the second length adjustment mechanism is spring-loaded to assist with adjustment of the second bar rack mechanism of the second vertical structure.

Example 16 may include the press equipment of example 13, wherein the second bar rack mechanism of the first vertical structure extends parallel to the bench for at least half a length of the bench, and wherein the second bar rack mechanism of the second vertical structure extends parallel to the bench for at least half the length of the bench.

Example 17 may include the press equipment of example 6, wherein the bench support structure includes a first adjustment mechanism and a second adjustment mechanism, and wherein the first adjustment mechanism and the second adjustment mechanism are to adjust a distance between the bench and the surface.

Example 18 may include the press equipment of example 17, wherein the first adjustment mechanism is a first jack mechanism, and wherein the second adjustment mechanism is a second jack mechanism.

Example 19 may include a bench press, comprising a bench supported at a first elevated level above a surface, a bar rack structure, comprising a first side structure located on a first side of the bench, wherein the first side includes a first side bar rack mechanism to receive a first portion of a barbell and at least partially support the barbell, the first side bar rack mechanism located at a second elevated level above the surface, the second elevated level further from the surface than the first elevated level, a second side structure located on a second side of the bench, the first side of the bench being opposite to the second side of the bench, wherein the second side structure includes a second side bar rack mechanism to receive a second portion of the barbell and at least partially support the barbell, the second side bar rack mechanism located at the second elevated level above the surface, and a connection structure that couples the first side structure to the second side structure, the connection structure to provide rigidity between the first side structure and the second side structure, and a platform located at a third elevated level above the surface, the third elevated level located between the first elevated level and the surface, wherein the platform extends along an end of the bench and at least partially along the first side of the bench and the second side of the bench, and wherein the connection structure passes between the platform and the surface within the surface of the platform.

Example 20 may include the bench press of example 19, wherein the barbell is located in a barbell resting position when received by the first side bar rack mechanism and the second side bar rack mechanism, and wherein at least a portion of the platform is located directly between the barbell resting position and the surface.

Example 21 may include the bench press of example 19, wherein the platform extends along the first side of the bench and the second side of the bench for at least a quarter of the length of the bench.

Example 22 may include the bench press of example 19, wherein at least a portion of the platform extends directly between the bench and the surface, and wherein a portion of a bench support structure, that supports the bench at the first elevated level, passes through an aperture in the platform and at least partially supports the bench on the surface.

Example 23 may include the bench press of example 19, wherein the connection structure is coupled to the platform, and wherein the connection structure supports the platform at the third elevated level.

Example 24 may include the bench press of example 19, wherein the connection structure includes one or more rigid tubes that extend between the first side structure and the second side structure.

Example 25 may include the bench press of example 19, further comprising a first adjustment mechanism coupled to the bench, the first adjustment mechanism to support a first portion of the bench above the surface, and a second adjustment mechanism coupled to the bench, the second adjustment mechanism to support a second portion of the bench above the surface, wherein the first elevated level is adjustable based on actuation of the first adjustment mechanism and the second adjustment mechanism.

It will be apparent to those skilled in the art that various modifications and variations can be made in the disclosed embodiments of the disclosed device and associated methods without departing from the spirit or scope of the disclosure. Thus, it is intended that the present disclosure covers the modifications and variations of the embodiments disclosed above provided that the modifications and variations come within the scope of any claims and their equivalents.

What is claimed is:

1. Press equipment, comprising:

a bench;

a bench support structure coupled to the bench, the bench support structure to support the bench on a surface;

a platform located at a distance from the surface less than a distance from the bench to the surface, wherein the platform extends around a portion of the bench on at least three sides of the bench, and wherein the platform has an aperture or slot through which at least a portion of the bench support structure extends;

a bar rack structure, wherein a first side of the bar rack structure is located on a first side of the bench and a second side of the bar rack structure is located on a second side of the bench, the second side of the bench being opposite to the first side of the bench; and a connection structure that extends between the first side of the bar rack structure and the second side of the bar rack structure, wherein the connection structure is to provide rigidity to the bar rack structure.

2. The press equipment of claim 1, wherein the platform extends on a first side of the bench and a second side of the bench, the second side of the bench being opposite to the first side of the bench, wherein the platform extends on the first side of the bench for at least a quarter of a length of the bench, and wherein the platform extends on the second side of the bench for at least a quarter of the length of the bench.

3. The press equipment of claim 1, wherein the connection structure is located between the platform and the surface.

4. The press equipment of claim 1, wherein the connection structure is coupled to the platform, and wherein the connection structure is to support the platform at the distance from the surface.

5. The press equipment of claim 1, wherein the connection structure comprises one or more rigid tubes that extend between the first side of the bar rack structure.

6. The press equipment of claim 1, wherein the first side of the bar rack structure includes a first vertical structure, wherein the second side of the bar rack structure includes a second vertical structure, and wherein the press equipment further comprises:

a first bar rack mechanism of the first vertical structure, the first bar rack mechanism of the first vertical structure to receive a first portion of a barbell, wherein the bench is located between the first bar rack mechanism of the first vertical structure and the surface;

a first bar rack mechanism of the second vertical structure, the first bar rack mechanism of the second vertical structure to receive a second portion of the barbell, wherein the bench is located between the first bar rack mechanism of the second vertical structure and the surface;

a second bar rack mechanism of the first vertical structure, the second bar rack mechanism of the first vertical structure to receive the first portion of the barbell, wherein the second bar rack mechanism of the first vertical structure is located between the first bar rack mechanism of the first vertical structure and the bench; and a second bar rack mechanism of the second vertical structure, the second bar rack mechanism of the second vertical structure to receive the second portion of the barbell, wherein the second bar rack mechanism of the second vertical structure is located between the first bar rack mechanism of the second vertical structure and the bench.

7. The press equipment of claim 6, wherein the first vertical structure includes a first length adjustment mechanism to adjust a distance between the second bar rack mechanism of the first vertical structure and the bench, and wherein the second vertical structure includes a second length adjustment mechanism to adjust a distance between the second bar rack mechanism of the second vertical structure and the bench.

8. The press equipment of claim 7, wherein the first length adjustment mechanism is spring-loaded to assist with adjustment of the second bar rack mechanism of the first vertical structure, and wherein the second length adjustment mechanism is spring-loaded to assist with adjustment of the second bar rack mechanism of the second vertical structure.

9. The press equipment of claim 6, wherein the second bar rack mechanism of the first vertical structure extends parallel to the bench for at least half a length of the bench, and wherein the second bar rack mechanism of the second vertical structure extends parallel to the bench for at least half the length of the bench.

10. The press equipment of claim 1, wherein the bench support structure includes a first adjustment mechanism and a second adjustment mechanism, and wherein the first adjustment mechanism and the second adjustment mechanism are to adjust a distance between the bench and the surface.

11. The press equipment of claim 10, wherein the first adjustment mechanism is a first jack mechanism, and wherein the second adjustment mechanism is a second jack mechanism.

12. A bench press, comprising:

a bench supported at a first elevated level above a surface;

a bar rack structure, comprising:

a first side structure located on a first side of the bench, wherein the first side structure includes a first side bar rack mechanism to receive a first portion of a barbell and at least partially support the barbell, the first side bar rack mechanism located at a second elevated level above the surface, the second elevated level further from the surface than the first elevated level;

a second side structure located on a second side of the bench, the first side of the bench being opposite to the second side of the bench, wherein the second side structure includes a second side bar rack mechanism to receive a second portion of the barbell and at least partially support the barbell, the second side bar rack mechanism located at the second elevated level above the surface; and a connection structure that couples the first side structure to the second side structure, the connection structure to provide rigidity between the first side structure and the second side structure; and a platform located at a third elevated level above the surface, the third elevated level located between the first elevated level and the surface, wherein the platform extends along an end of the bench and at least partially along the first side of the bench and the second side of the bench, wherein the platform has an aperture or slot through which at least a portion of the bench support structure extends, and wherein the connection structure passes between the platform and the surface.

13. The bench press of claim 12, wherein the barbell is located in a barbell resting position when received by the first side bar rack mechanism and the second side bar rack mechanism, and wherein at least a portion of the platform is located directly between the barbell resting position and the surface.

14. The bench press of claim 12, wherein the platform extends along the first side of the bench and the second side of the bench for at least a quarter of the length of the bench.

15. The bench press of claim 12, wherein the connection structure is coupled to the platform, and wherein the connection structure supports the platform at the third elevated level.

16. The bench press of claim 12, wherein the connection structure includes one or more rigid tubes that extend between the first side structure and the second side structure.

17. The bench press of claim 12, further comprising:

a first adjustment mechanism coupled to the bench, the first adjustment mechanism to support a first portion of the bench above the surface; and a second adjustment mechanism coupled to the bench, the second adjustment mechanism to support a second portion of the bench above the surface, wherein the first elevated level is adjustable based on actuation of the first adjustment mechanism and the second adjustment mechanism.

* * * * *